US008507161B2

(12) United States Patent
Wu et al.

(10) Patent No.: US 8,507,161 B2
(45) Date of Patent: Aug. 13, 2013

(54) PHENOLIC PHOSPHITE CONTAINING PHOTOCONDUCTORS

(75) Inventors: Jin Wu, Pittsford, NY (US); Kenny-Tuan T. Dinh, Webster, NY (US); Terry L. Street, Fairport, NY (US); Robert W. Hedrick, Spencerport, NY (US); Linda L. Ferrarese, Rochester, NY (US); Brian P. Gilmartin, Williamsville, NY (US)

(73) Assignee: Xerox Corporation, Norwalk, CT (US)

( * ) Notice: Subject to any disclaimer, the term of this patent is extended or adjusted under 35 U.S.C. 154(b) by 159 days.

(21) Appl. No.: 13/183,878

(22) Filed: Jul. 15, 2011

(65) Prior Publication Data

US 2013/0017479 A1 Jan. 17, 2013

(51) Int. Cl.
*G03G 5/147* (2006.01)
*G03G 5/06* (2006.01)

(52) U.S. Cl.
USPC ..... 430/58.8; 430/66

(58) Field of Classification Search
USPC ..... 430/66, 58.8, 58.7
See application file for complete search history.

(56) References Cited

U.S. PATENT DOCUMENTS

| | | | | |
|---|---|---|---|---|
| 4,273,846 | A * | 6/1981 | Pai et al. | 430/58.75 |
| 5,147,751 | A * | 9/1992 | Kojima et al. | 430/119.71 |
| 5,215,843 | A | 6/1993 | Aizawa | |
| 6,171,741 | B1 * | 1/2001 | Evans et al. | 430/58.35 |
| 7,498,108 | B2 | 3/2009 | Wu et al. | |
| 7,560,205 | B2 * | 7/2009 | Qi et al. | 430/58.75 |
| 7,799,494 | B2 | 9/2010 | Wu et al. | |
| 7,811,732 | B2 | 10/2010 | Wu | |
| 7,897,311 | B2 | 3/2011 | Wu | |
| 2006/0014097 | A1 * | 1/2006 | Perry et al. | 430/133 |
| 2008/0107983 | A1 * | 5/2008 | Yanus et al. | 430/58.8 |
| 2009/0233197 | A1 * | 9/2009 | Heuft et al. | 430/58.35 |
| 2011/0171570 | A1 * | 7/2011 | Takimoto et al. | 430/56 |

FOREIGN PATENT DOCUMENTS

JP 04045454 A * 2/1992

* cited by examiner

*Primary Examiner* — Christopher Rodee
(74) *Attorney, Agent, or Firm* — Eugene O. Palazzo

(57) ABSTRACT

A photoconductor containing an optional supporting substrate layer, a photogenerating layer, a charge transport layer, and a top overcoat layer of a phenolic compound, a phosphite compound, an optional charge transport compound, an optional melamine resin, an optional acrylated polyol, and an optional catalyst.

8 Claims, 1 Drawing Sheet

PHENOLIC PHOSPHITE CONTAINING PHOTOCONDUCTORS

There is disclosed a photoconductor comprising a photogenerating layer, a charge transport layer, and an overcoat layer comprising a mixture of a phenolic compound and a phosphite compound.

BACKGROUND

A number of photoconductors that are selected for imaging systems, such as xerographic imaging processes, are known. A problem associated with certain known photoconductors is that they are adversely affected by not being light shock resistant. Light shock or photoconductor fatigue usually causes dark bands in the resulting xerographic prints from the light exposed photoconductor area at time zero.

Many known photoconductors cause undesirable image ghosting on the developed xerographic images. This ghosting causes image defects, and unwanted background deposits. This ghosting in turn may require the untimely replacement of photoconductors at significant costs.

Many photoconductors also have a minimum or lack resistance to abrasion from dust, charging rolls, toner, and carrier. For example, the surface layers of photoconductors are subject to scratches, which decrease their lifetime, and in xerographic imaging systems adversely affect the quality of the developed images. While used photoconductor components can be partially recycled, there continues to be added costs and potential environmental hazards when recycling.

Thus, there is a need for light shock and ghost resistant photoconductors with excellent or acceptable mechanical characteristics, especially in xerographic systems where biased charging rolls (BCR) are used.

Photoconductors with excellent cyclic characteristics and stable electrical properties, stable long term cycling, minimal charge deficient spots (CDS), and acceptable lateral charge migration (LCM) characteristics, such as excellent LCM resistance, are also desirable needs.

Further, there is a need for photoconductors with suppressed J zone parking deletion, which prevents or minimizes oxidation of the charge transport compounds present in the charge transport layer by nitrous oxide ($NO_x$) originating from xerographic corotron devices.

These and other needs are believed to be achievable with the photoconductors disclosed herein.

SUMMARY

Disclosed is a photoconductor comprising a photogenerating layer, a charge transport layer, and an overcoat layer comprising a mixture of a phenolic compound and a phosphite compound.

Further, disclosed is a photoconductor comprising a supporting substrate, a photogenerating layer, a charge transport layer, and a crosslinked overcoat layer comprising a phenolic compound, and a phosphite compound represented by at least one of the following formulas/structures

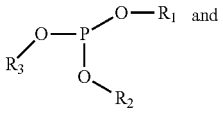

-continued

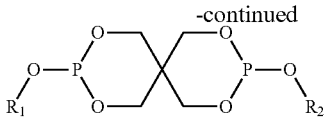

wherein $R_1$, $R_2$, $R_3$ are selected from the group consisting of alkyl, aryl, and mixtures thereof, a charge transport compound, and a melamine resin Also, disclosed is a photoconductor comprising an optional supporting substrate, a photogenerating layer, a charge transport layer, and an overcoat layer comprising a phenolic compound, a phosphite compound, a charge transport compound, and a melamine resin, and wherein the photoconductor is light shock resistant with delta Volts ($\Delta V$) at 1.5 ergs/cm$^2$ of from about 1 to about 10 Volts as measured by a photoinduced discharge curve.

FIGURES

There are provided the following Figures to further illustrate the photoconductors disclosed herein.

EMBODIMENTS

In embodiments of the present disclosure, there is illustrated a photoconductor comprising an optional supporting substrate, a photogenerating layer, a charge transport layer, and an overcoat layer. Further, optional layers that can be present in the disclosed photoconductors include an anticurl layer, a hole blocking layer, an adhesive layer, and the like.

Figure 1:
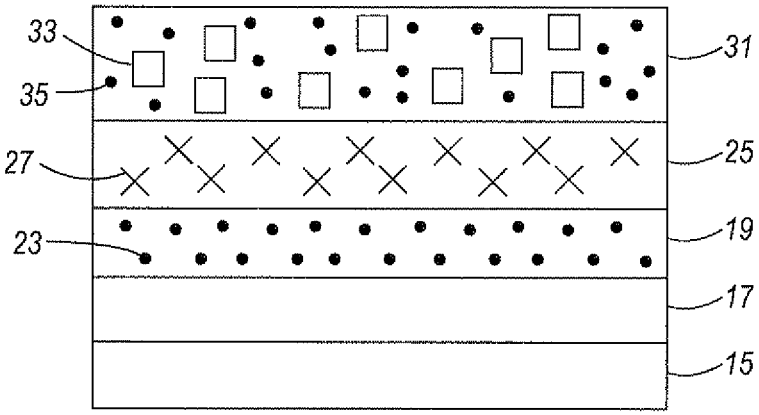
FIG. 1 illustrates an exemplary embodiment of an overcoated layered photoconductor of the present disclosure.
Figure 2:
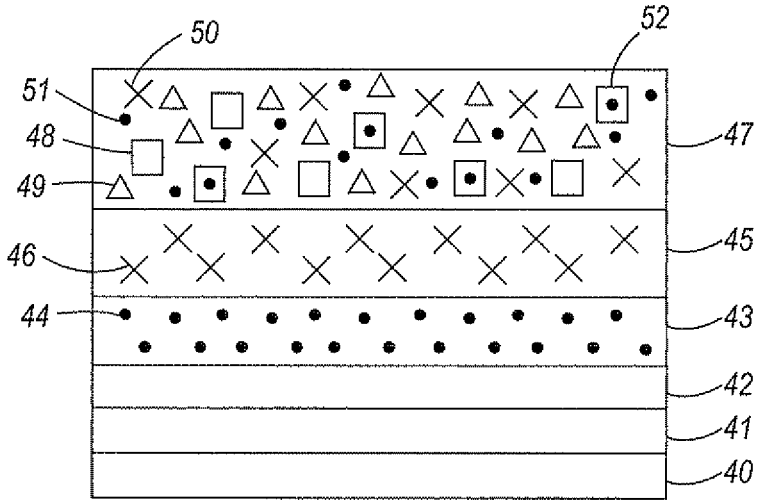
FIG. 2 illustrates an exemplary embodiment of a crosslinked layered photoconductor of the present disclosure.

Exemplary and non-limiting examples of photoconductors according to embodiments of the present disclosure are depicted in FIGS. 1 and 2.

In FIG. 1, there is illustrated an overcoated photoconductor comprising an optional supporting substrate layer 15, an optional hole blocking layer 17, a photogenerating layer 19 containing photogenerating pigments 23, a charge transport layer 25 containing charge transport compounds 27, and an overcoat layer 31 containing a mixture of a phenolic compound 3, and a phosphite compound 35.

In FIG. 2, there is illustrated an overcoated photoconductor comprising an optional supporting substrate layer 40, an optional hole blocking layer 41, an optional adhesive layer 42, a photogenerating layer 43 containing photogenerating pigments 44, a charge transport layer 45 containing charge transport compounds 46, and an overcoat layer 47 containing a crosslinked mixture of a phenolic component 48, a phosphite compound 49, an optional charge transport compound 50, an optional crosslinking agent 51, and an optional acrylated polyol 52.

Overcoat Layer

The disclosed overcoat layer usually in contact with the photoconductor top charge transport layer comprises a mixture of a phenolic compound and a phosphite compound optionally dispersed in a crosslinked polymeric matrix comprised, for example, of one or more charge transport compounds and a melamine resin, an optional polyol resin, an optional acid catalyst, and an optional polysiloxane copolymer or an optional fluoropolymer. One exemplary charge transport compound selected for the overcoat layer is N,N'-diphenyl-N,N-diphenyl-N,N'-bis(3-hydroxyphenyl)-[1,1'-biphenyl]-4,4'-diamine.

Examples of phenolic compounds that can be included in the disclosed overcoating layer mixture are, for example, 1,3,5-tris(4-tert-butyl-3-hydroxy-2,6-dimethylbenzyl)-1,3,5-triazine-2,4,6-(1H,3H,5H)-trione, 1,3,5-tris(3,5-di-tert-butyl-4-hydroxybenzyl)-s-triazine-2,4,6(1H,3H,5H)trione, 2-[4,6-bis(2,4-dimethylphenyl)-1,3,5-triazin-2-yl]-5-(octyloxy)phenol, 2-(2'-hydroxy-3',5'-di-t-amylphenyl)benzotriazole, 2-(2'-hydroxy-3',5'-di-t-butylphenyl)-5-chlorobenzotriazole, and 2-(2'-hydroxy-5'-octylphenyl)-benzotriazole, such as those represented by the following formulas/structures, and mixtures thereof

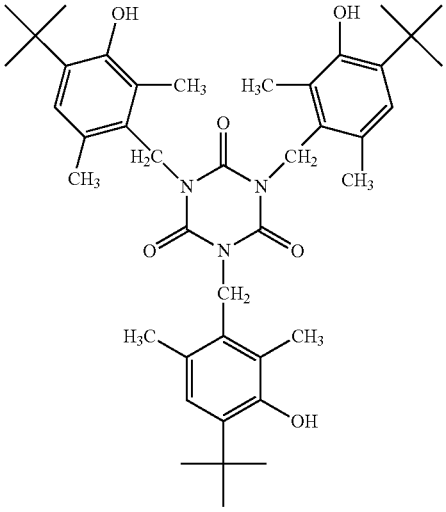

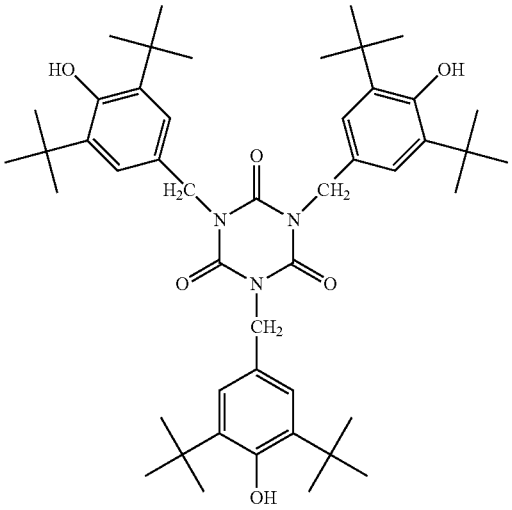

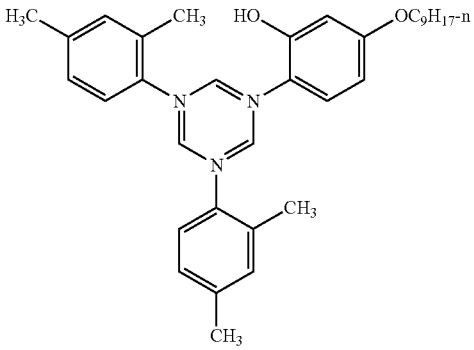

-continued

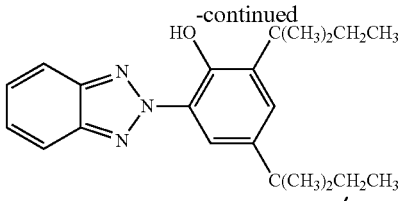

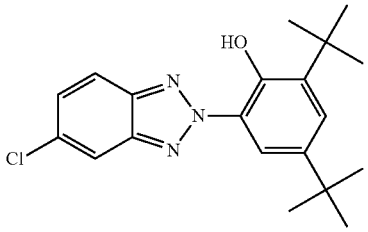

or

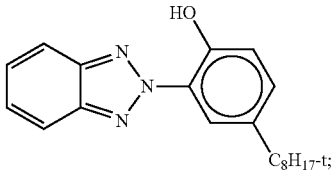

tetrakis-(methylene-(3,5-di-tertbutyl-4-hydrocinnamate) methane, 4,4'-butylidenebis(6-t-butyl-m-cresol), (octadecanoxycarbonylether)phenol, 4,4'-thiobis-6-(t-butyl-m-cresol), 2,6-Di-tert-butyl-p-cresol, and the like.

The phenolic compound can be present in the overcoat layer in a range of different amounts, such as for example from about 0.1 to about 10 percent by weight, from about 0.5 to about 5 percent by weight, or from about 0.5 to about 1.5 weight percent based on the total solids.

The phosphites selected for the overcoating mixture can be represented by the following formulas/structures, or mixtures thereof

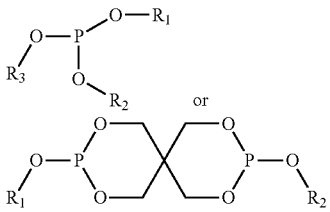

wherein $R_1$, $R_2$, $R_3$ are independently alkyl with, for example, from about 1 to about 18 carbon atoms, from 1 to about 15 carbon atoms, from 1 to about 12 carbon atoms, or from about 4 to about 12 carbon atoms, and aryl with, for example, from about 6 to about 36 carbon atoms, from about 6 to about 24 carbon atoms, from about 6 to about 18 carbon atoms, from about 6 to about 12 carbon atoms or from about 12 to about 24 carbon atoms, or mixtures of alkyl and aryl.

Suitable alkyl groups include methyl, ethyl, propyl, butyl, pentyl, heptyl, octyl, nonyl, decyl, dodecyl, undecyl, dodecyl, pentadecyl, isomers thereof, and the like, and mixtures thereof. Suitable aryl groups include phenyl, napthyl, anthryl, substituted derivatives thereof, such as benzylphenyl, and the like, and mixtures thereof.

Examples of phosphite compounds that can be included in the overcoating layer mixture are represented by the following formulas/structures or mixtures thereof

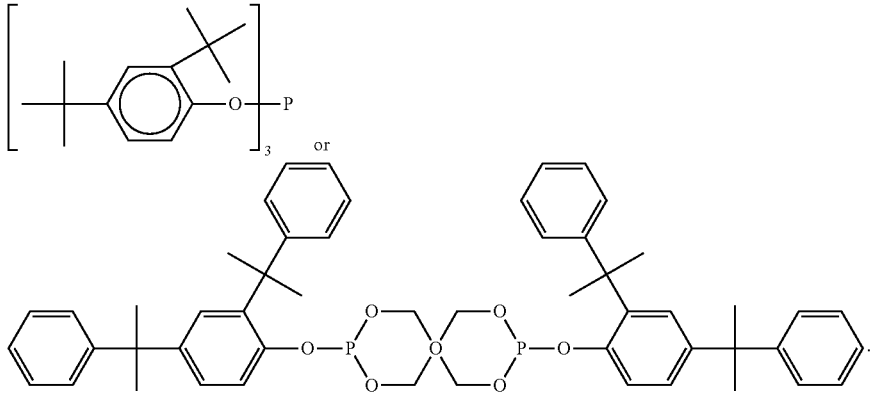

Specific examples of phosphites contained in the disclosed overcoating layer mixture are tris(2,4-di-t-butylphenyl)phosphite, bis(2,4-dicumylphenyl)pentaerythritol diphosphite, triphenylphosphite, tributylphosphite, or tris(nonylphenyl) phosphite.

As desired, the phenolic compound and the phosphite compound can be provided as separate compounds, or can be provided in the form of a mixture of the phenolic compound and the phosphite compound. Examples of commercially available mixtures of the phenolic compound and the phosphite compound, such as available from CYTEC Industries Inc., include CYANOX® 2777 (1:2 blend of 1,3,5-tris(4-tert-butyl-3-hydroxy-2,6-dimethylbenzyl)-1,3,5-triazine-2,4,6-(1H,3H,5H)-trione and tris(2,4-di-t-butylphenyl)phosphite), CYANOX® 2888 (1:3 blend of 1,3,5-tris(4-tert-butyl-3-hydroxy-2,6-dimethylbenzyl)-1,3,5-triazine-2,4,6-(1H,3H,5H)-trione and tris(2,4-di-t-butylphenyl)phosphite), CYANOX® XS4 (1:1 blend of 1,3,5-tris(4-tert-butyl-3-hydroxy-2,6-dimethylbenzyl)-1,3,5-triazine-2,4,6-(1H,3H,5H)-trione), and bis(2,4-dicumylphenyl)pentaerythritol diphosphite, and the like.

The phosphite compound can be present in the overcoat layer in a range of different amounts, such as for example from about 0.1 to about 5 percent by weight, from about 0.5 to about 3 percent by weight, or from about 0.5 to about 1.5 weight percent based on the total solids.

Whether provided separately or in the form of a mixture, the mixture of the phenolic compound and the phosphite compound can be present in the overcoat layer in an amount of, for example, from about 0.1 to about 10 weight percent, from about 0.5 to about 7 weight percent, from 1 to about 5 weight percent, or from 1 to about 2 weight percent based on the total solids.

Also, included in the overcoat layer mixture is a number of known film forming polymers, such as melamine resins. Any suitable film-forming polymers can be used, depending upon desired properties of the photoconductor. Examples of a melamine resin that can be selected for the photoconductor overcoat layer can be represented by the following formulas/structures

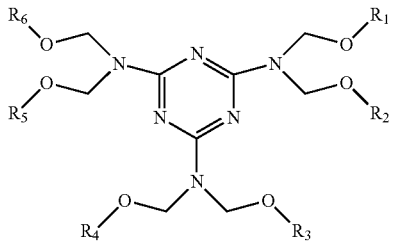

wherein $R_1$, $R_2$, $R_3$, $R_4$, $R_5$ and $R_6$ each independently represents at least one of a hydrogen atom, and alkyl with, for example, from 1 to about 12 carbon atoms, from 1 to about 8 carbon atoms, or from 1 to about 4 carbon atoms, examples of specific alkyl substituents being illustrated herein such as methyl, ethyl, propyl, butyl, pentyl, hexyl, heptyl, octyl, nonyl, decyl, undecyl, dodecyl, pentadecyl, and the like.

Examples of melamine resins selected for the photoconductor overcoat layer include highly methylated/butylated melamine formaldehyde resins, such as those commercially available from Cytec Industries, as CYMEL® 303, 104, MM-100, and the like. These melamine formaldehyde resins, which are water-soluble, dispersible or nondispersible, exhibit a high, such as about 75 to about 95 percent, from about 80 to about 95 percent, from about 75 to about 90 percent, or from about 85 to about 90 percent of alkylation.

One exemplary methoxymethylated melamine resin that can be selected for the overcoat layer is CYMEL®303, available from Cytec Industries as $(CH_3OCH_2)_6N_3C_3N_3$), and represented by the following formula/structure

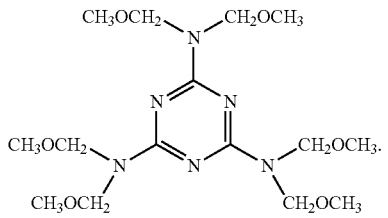

Specific examples of melamine resins present in the overcoat layer include highly, for example, alkylated/alkoxylated resin (having from about 75 to about 95 percent, from 80 to about 95 percent, from about 75 to about 90 percent, or from about 85 to about 90 percent alkylation), partially alkylated resins (having from about 40 to about 65 percent alkylation), or mixed alkylated/alkoxylated resins. Specific examples include methylated, n-butylated or isobutylated resins; highly methylated melamine resins such as CYMEL®350, CYMEL®9370; methylated imino melamine resins (partially methylolated and highly alkylated) such as CYMEL®323, CYMEL®327; methylated melamine resins (highly methylolated and partially methylated) such as CYMEL®373, CYMEL®370; high solids mixed ether melamine resins such as CYMEL®1130, CYMEL®324; n-butylated melamine resins such as CYMEL®1151, CYMEL®615; n-butylated high imino melamine resins such as CYMEL®1158; or isobutylated melamine resins such as CYMEL®255-10. CYMEL® melamine resins are commercially available from CYTEC Industries, Inc.

More specifically, the disclosed overcoat melamine resin may be selected from the group consisting of methylated melamine resins, methoxymethylated melamine resins, ethoxymethylated melamine resins, propoxymethylated melamine resins, butoxymethylated melamine resins, hexamethylol melamine resins, alkoxyalkylated melamine resins such as methoxymethylated melamine resin, ethoxymethylated melamine resin, propoxymethylated melamine resin, butoxymethylated melamine resin, and mixtures thereof.

The melamine resin, which can function as a crosslinking agent, is present in the photoconductor overcoat layer mixture in an amount of from about 1 to about 80 weight percent, from about 10 to about 70 weight percent, or from about 20 to about 60 weight percent based on the total solids of the overcoat layer. The ratio of overcoat charge transport compound to the melamine resin can be from about 20/80 to about 98/2, from about 30/70 to about 90/10, from about 40/60 to about 80/20, or about 50/50.

The overcoat charge transport component or compound selected for the disclosed photoconductor overcoat layer can be, for example, a crosslinkable alcohol soluble compound represented by

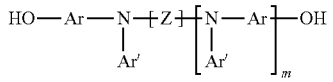

wherein m represents the number of segments and is, for example, zero or 1; Z is selected from the group consisting of at least one of

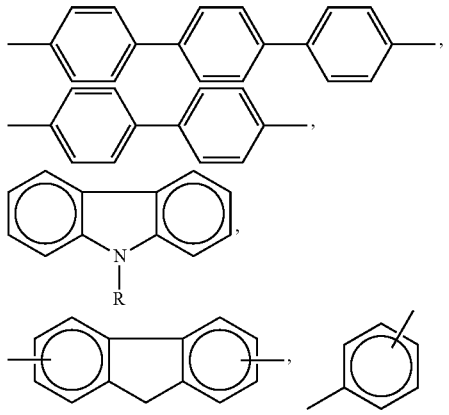

-continued

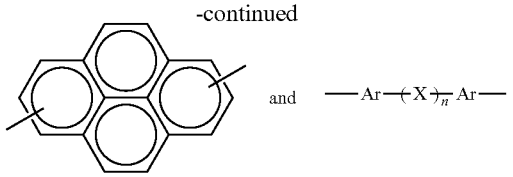

wherein n represents the number of X substituents, such as 0 or 1; Ar is selected from the group consisting of at least one of

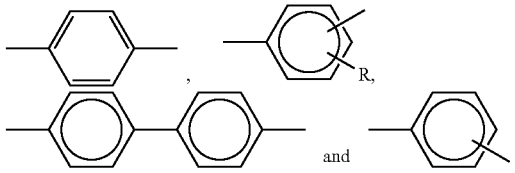

where R is selected from the group consisting of at least one of alkyl such as methyl, ethyl, propyl, butyl, pentyl, and the like; Ar' is selected from the group consisting of at least one of

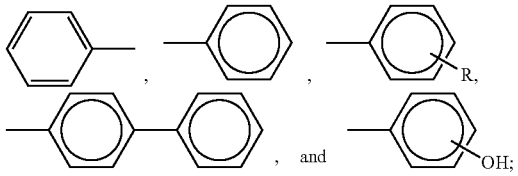

and X is selected from the group consisting of at least one of

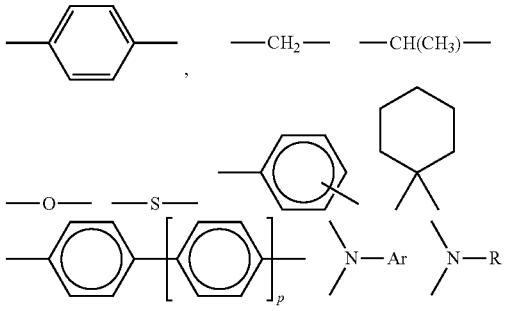

wherein p represents the number of segments and is, for example, zero, 1, or 2; R is alkyl, and Ar is selected from the group consisting of at least one of the substituents represented by the following formulas/structures

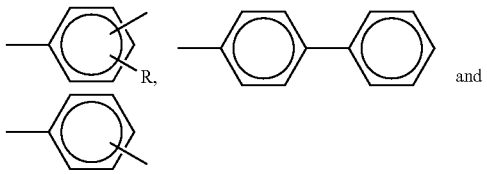

wherein R is alkyl.

Also, examples of charge transport compounds present in the overcoat layer are hydroxyl biphenylamines, such as N,N'-diphenyl-N,N-diphenyl-N,N'-bis(3-hydroxyphenyl)-[1,1'-biphenyl]-4,4'-diamine, represented by

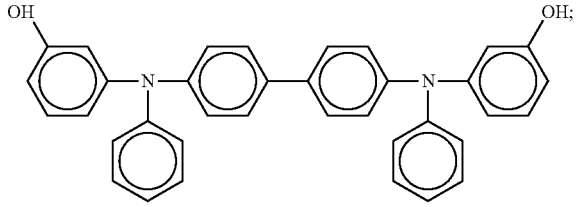

or hydroxyl terphenylamines represented by

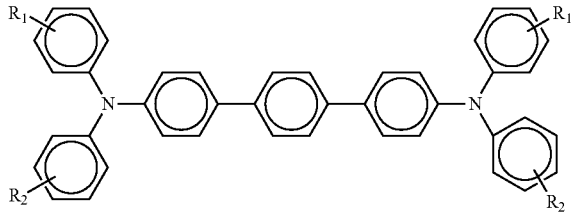

wherein each $R_1$ and $R_2$ is independently selected from the group consisting of at least one of a hydrogen atom, a hydroxy group, a group represented by $—C_nH_{2n+1}$ where n is from 1 to about 12 or from 1 to about 6, arylalkyl, and aryl groups with from about 6 to about 36 carbon atoms, from about 6 to about 24 carbon atoms, from 6 to about 18 carbon atoms, or from 6 to about 12 carbon atoms, and mixtures of hydroxyl aryl amines and dihydroxyaryl terphenylamines.

The overcoat charge transport compound is present, for example, in an amount of from about 10 to about 98 percent by weight, from about 20 to about 98 percent by weight, from about 30 to about 75 percent by weight, from about 40 to about 70 percent by weight, or from about 45 to about 65 percent by weight based on the total solids.

Examples of optional acrylated polyols selected for the disclosed photoconductor overcoat layer are highly branched polyols where highly branched refers, for example, to a prepolymer synthesized using a sufficient amount of trifunctional alcohols, such as triols, or a polyfunctional polyol with a high hydroxyl number to form a polymer comprising a number of branches off of the main polymer chain. The polyol can possess a hydroxyl number of, for example, from about 10 to about 10,000, and can include ether groups, or can be free of ether groups.

Suitable acrylated polyols incorporated into the overcoat layer can be, for example, generated from the reaction products of propylene oxide modified with ethylene oxide, glycols, triglycerol, and the like, and wherein the acrylated polyols can be represented by the following formula $$[R_t—CH_2]_m—[—CH_2—R_a—CH_2]_p—[—CO—R_b—CO—]_n—[—CH_2—R_c—CH_2]_p—[—CO—R_d—CO—]_q$$

wherein $R_t$ represents $CH_2CR_1CO_2$—, $R_1$ is alkyl with, for example, from 1 to about 25 carbon atoms, such as from 1 to about 12 carbon atoms, such as methyl, ethyl, propyl, butyl, hexyl, heptyl, and the like; $R_a$ and $R_c$ independently represent linear alkyl groups, alkoxy groups, branched alkyl or branched alkoxy groups with alkyl and alkoxy groups possessing, for example, from 1 to about 20 carbon atoms; $R_b$ and $R_d$ independently represent alkyl or alkoxy groups having, for example, from 1 to about 20 carbon atoms; and m, n, each p, and q represent mole fractions of from 0 to 1, such that m+n+p+p+q is equal to about 1. Examples of commercial acrylated polyols are JONCRYL™ polymers, available from Johnson Polymers Inc. and POLYCHEM™ polymers, available from OPC polymers.

When present, the acrylated polyol can be present in the overcoat in an amount of, for example, from about 1 to about 50 percent by weight, from about 5 to about 40 percent by weight, or from about 10 to about 25 percent by weight based on the total solids.

In embodiments, the overcoat layer is desirably crosslinked. While not being desired to be limited by theory, it is believed that the crosslinking percentage of the overcoat layer components is from about 75 to about 99 percent, from about 80 to about 95 percent, or from about 70 to about 90 percent as determined by known methods, such as determined with Fourier Transform Infrared Spectroscopy (FTJR).

The crosslinking reaction of the melamine resin, the phenolic compound, the phosphite compound, the charge transport material, and the optional acrylated polyol can be catalyzed with a strong acid catalyst. Examples of strong acid catalysts include p-toluene sulfonic acid, commercially available acid catalysts such as CYCAT® 600, CYCAT® 4040, and the like. In embodiments, the catalyst is added to the overcoat layer mixture components in an amount of, for example, from about 0.1 to about 5 weight percent, from about 0.3 to about 3 weight percent, from about 0.5 to about 1.5 percent by weight, or from about 0.4 to about 1 weight percent based on the total solids.

The overcoat layer, in embodiments of the present disclosure, can be prepared by coating on the photoconductor charge transport layer, a solution of a solvent like an alcohol, the phenolic compound, the phosphite compound, the melamine resin, the charge transport compound, the optional acrylated polyol, and an acid catalyst, followed by heating to a temperature of, for example, from about 120 to about 200° C. for a period of, for example, from about 30 to about 120 minutes, and allowing the resulting mixture to cool to room temperature (about 25° C.). Any suitable solvent, such as a primary, secondary or tertiary alcohol solvent, can be employed for the deposition of the film forming overcoat layer. Typical alcohol solvents include, but are not limited to, tert-butanol, sec-butanol, n-butanol, 2-propanol, 1-methoxy-2-propanol, cyclopentyl alcohol, and the like, and mixtures thereof. There may also be selected as deposition solvents for the formation of the overcoat layer tetrahydrofuran, monochlorobenzene, methylene chloride, toluene, cyclopentanone, xylene, and mixtures thereof.

There may also be included in the overcoat layer low surface energy components, such as hydroxyl terminated fluorinated additives, hydroxyl silicone modified polyacrylates, and mixtures thereof. Examples of the low surface energy components are hydroxyl derivatives of perfluoropolyoxyalkanes such as FLUOROLINK® D (M.W. about 1,000 and fluorine content about 62 percent), FLUOROLINK® D10-H (M.W. about 700 and fluorine content about 61 percent), and FLUOROLINK® D10 (M.W. about 500 and fluorinecontent about 60 percent) (functional group $—CH_2OH$); FLUOROLINK® E (M.W. about 1,000 and fluorine content about 58 percent) and FLUOROLINK® E10 (M.W. about 500 and fluorine content about 56 percent) (functional group $—CH_2(OCH_2CH_2)_nOH$); FLUOROLINK® T (weight average molecular weight, M.W. about 550 and fluorine content about 58 percent) and FLUOROLINK® T10 (M.W. about 330 and fluorine content about 55 percent) (functional group $—CH_2OCH_2CH(OH)CH_2OH$); and hydroxyl derivatives of perfluoroalkanes ($R_fCH_2CH_2OH$, wherein $R_f$=$F(CF_2CF_2)_n$)

such as ZONYL® BA (M.W. about 460 and fluorine content about 71 percent), ZONYL® BA-L (M.W. about 440 and fluorine content about 70 percent), ZONYL® BA-LD (M.W. about 420 and fluorine content about 70 percent), and ZONYL® BA-N (M.W. about 530 and fluorine content about 71 percent); carboxylic acid derivatives of fluoropolyethers such as FLUOROLINK® C (M.W. about 1,000 and fluorine content about 61 percent), carboxylic ester derivatives of fluoropolyethers such as FLUOROLINK® L (M.W. about 1,000 and fluorine content about 60 percent), FLUOROLINK® L10 (M.W. about 500 and fluorine content about 58 percent), carboxylic ester derivatives of perfluoroalkanes ($R_fCH_2CH_2O(C{=}O)R$, wherein $R_f{=}F(CF_2CF_2)_n$ and R is alkyl) such as ZONYL® TA-N (fluoroalkyl acrylate, $R{=}CH_2{=}CH{-}$, M.W. about 570 and fluorine content about 64 percent), ZONYL® TM (fluoroalkyl methacrylate, $R{=}CH_2{=}C(CH_3){-}$, M.W. about 530 and fluorine content about 60 percent), ZONYL® FTS (fluoroalkyl stearate, $R{=}C_{17}H_{35}{-}$, M.W. about 700 and fluorine content about 47 percent), ZONYL® TBC (fluoroalkyl citrate, M.W. about 1,560 and fluorine content about 63 percent), sulfonic acid derivatives of perfluoroalkanes ($R_fCH_2CH_2\ SO_3H$, wherein $R_f{=}F(CF_2CF_2)_n$) such as ZONYL® TBS (M.W. about 530 and fluorine content about 62 percent); ethoxysilane derivatives of fluoropolyethers such as FLUOROLINK® S10 (M.W. about 1,750 to 1,950); phosphate derivatives of fluoropolyethers such as FLUOROLINK® F10 (M.W. about 2,400 to 3,100); hydroxyl derivatives of silicone modified polyacrylates such as BYK-SILCLEAN® 3700; polyether modified acryl polydimethylsiloxanes such as BYK-SILCLEAN® 3710; and polyether modified hydroxyl polydimethylsiloxanes such as BYK-SILCLEAN® 3720. FLUOROLINK® is a trademark of Ausimont, Inc., ZONYL® is a trademark of E.I. DuPont, and BYK-SILCLEAN® is a trademark of BYK SILCLEAN.

The disclosed overcoat optional low surface energy components, when used, can be present in various effective amounts, such as from about 0.1 to about 10 weight percent, from about 0.5 to about 5 weight percent, or from about 1 to about 3 weight percent, based on the total solids.

Typical application techniques for applying the overcoat layer mixture over the outermost charge transport layer can include spraying, dip coating, roll coating, wire wound rod coating, extrusion coating, flow coating, and the like. Drying of the deposited overcoat layer can be effected by any suitable conventional technique such as oven drying, infrared radiation drying, air drying, and the like.

The overcoat layer in embodiments can be of any suitable thickness to provide desired results. For example, the thickness of the overcoat layer as measured with a Permascope can be from about 1 to about 20 microns, from about 1 to about 15 microns, from about 1 to about 10 microns, or from about 1 to about 5 microns.

Optional Substrates

An optional supporting substrate can be included in the photoconductors illustrated herein. The substrate selected for the photoconductors of the present disclosure may comprise a layer of an electrically substantially nonconductive material or a layer of a conductive material. Examples of known nonconducting supporting substrate materials include polyesters, polycarbonates, polyamides, polyurethanes, and the like, and mixtures thereof.

In embodiments, when the photoconductor supporting substrate layer is not conductive, the surface may be rendered electrically conductive by depositing thereon a known electrically conductive coating like a coating of a metal oxide. The conductive coating may vary in thickness, such as from about 1 to about 50 microns, from 1 to about 35 microns, or from about 3 to about 25 microns, depending upon the optical transparency to be achieved, degree of flexibility desired, and economic factors.

An electrically conducting optional supporting substrate that may be selected for the photoconductors illustrated herein include metal containing polymers, titanium containing MYLAR®, metals including aluminum, nickel, steel, copper, gold, and the like, and mixtures thereof filled with an electrically conducting substance. Examples of electrically conducting substances include carbon, metallic powder, and the like, or an organic electrically conducting material.

Illustrative examples of photoconductor optional supporting substrates include a layer of insulating material including inorganic or organic polymeric materials, such as MYLAR® (a commercially available polymer), a MYLAR® containing titanium layer, a layer of an organic or inorganic material having a semiconductive surface layer, such as indium tin oxide or aluminum arranged thereon, or a conductive material inclusive of aluminum, chromium, nickel, brass, or the like, and mixtures thereof.

The thickness of the photoconductor optional supporting substrate depends on many factors, including economical considerations, electrical characteristics, adequate flexibility, availability and cost of the specific components for each layer, and the like. Thus, this layer may be of a substantial thickness, for example, up to about 3,500 microns, such as from about 1,000 to about 2,500 microns, from about 500 to about 1,000 microns, from about 300 to about 700 microns, or of a minimum thickness of from about 75 to about 125 microns. In embodiments, the thickness of this layer is from about 75 to about 300 microns, or from about 100 to about 150 microns.

The optional substrate may be flexible, seamless, or rigid, and may have a number of many different configurations, such as for example, a plate, a cylindrical drum, a scroll, an endless flexible belt, a drelt (a cross between a drum and a belt), and the like. In embodiments, the photoconductor substrate is in the form of a seamless flexible belt.

Anticurl Layer

In some situations, it may be desirable to coat a known anticurl layer on the back of the photoconductor substrate, particularly when the substrate is a flexible organic polymeric material. This anticurl layer, which is sometimes referred to as an anticurl backing layer, minimizes undesirable curling of the substrate. Suitable materials selected for the disclosed photoconductor anticurl layer include, for example, polycarbonates commercially available as MAKROLON®, polyesters, and the like. The anticurl layer can be of a thickness of from about 5 to about 40 microns, from about 10 to about 30 microns, or from about 15 to about 25 microns.

Ground Plane Layer

Positioned on the top side of the supporting substrate, there can be included an optional ground plane such as gold, gold containing compounds, aluminum, titanium, titanium/zirconium, and other suitable known components. The thickness of the ground plane layer can be from about 10 to about 100 nanometers, from about 20 to about 50 nanometers, from about 10 to about 30 nanometers, from about 15 to about 25 nanometers, or from about 20 to about 35 nanometers.

Hole-Blocking Layer

An optional charge blocking layer or hole blocking layer may be applied to the photoconductor supporting substrate, such as an electrically conductive supporting substrate surface prior to the application of a photogenerating layer. An optional charge blocking layer or hole blocking layer, when present, is usually in contact with the ground plane layer, and also can be in contact with the supporting substrate. The hole blocking layer generally comprises any of a number of known components as illustrated herein, such as metal oxides, phenolic resins, aminosilanes, and the like, and mixtures thereof. The hole blocking layer can have a thickness of from about 0.01 to about 30 microns, from about 0.02 to about 5 microns, or from about 0.03 to about 2 microns.

Examples of aminosilanes included in the hole blocking layer can be represented by the following formulas/structures

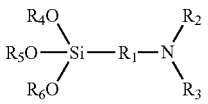

wherein $R_1$ is alkylene, straight chain, or branched containing, for example, from 1 to about 25 carbon atoms, from 1 to about 18 carbon atoms, from 1 to about 12 carbon atoms, or from 1 to about 6 carbon atoms; $R_2$ and $R_3$ are, for example, independently selected from the group consisting of at least one of a hydrogen atom, alkyl containing, for example, from 1 to about 12 carbon atoms, from 1 to about 10 carbon atoms, or from 1 to about 4 carbon atoms; aryl containing, for example, from about 6 to about 24 carbon atoms, from about 6 to about 18 carbon atoms, or from about 6 to about 12 carbon atoms, such as a phenyl group, and a poly(alkylene amino) group, such as a poly(ethylene amino) group, and where $R_4$, $R_5$ and $R_6$ are independently an alkyl group containing, for example, from 1 to about 12 carbon atoms, from 1 to about 10 carbon atoms, or from 1 to about 4 carbon atoms.

Specific examples of suitable hole blocking layer aminosilanes include 3-aminopropyl triethoxysilane, N,N-dimethyl-3-aminopropyl triethoxysilane, N-phenylaminopropyl trimethoxysilane, triethoxysilylpropylethylene diamine, trimethoxysilyipropylethylene diamine, trimethoxysilyipropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy) silane, p-aminophenyl trimethoxysilane, N,N'-dimethyl-3-aminopropyl triethoxysilane, 3-aminopropyimethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and the like, and mixtures thereof. Specific aminosilanes incorporated into the hole blocking layer are 3-aminopropyl triethoxysilane (γ-APS), N-aminoethyl-3-aminopropyl trimethoxysilane, (N,N'-dimethyl-3-amino)propyl triethoxysilane, or mixtures thereof.

The hole blocking layer aminosilane may be treated to form a hydrolyzed silane solution before being added into the final hole blocking layer coating solution or dispersion. During hydrolysis of the aminosilanes, the hydrolyzable groups, such as the alkoxy groups, are replaced with hydroxyl groups. The pH of the hydrolyzed silane solution can be controlled to from about 4 to about 10, or from about 7 to about 8 to thereby result in photoconductor electrical stability. Control of the pH of the hydrolyzed silane solution may be affected with any suitable material, such as generally organic acids or inorganic acids. Examples of organic and inorganic acids selected for pH control include acetic acid, citric acid, formic acid, hydrogen iodide, phosphoric acid, hydrofluorosilicic acid, p-toluene sulfonic acid, and the like.

The hole blocking layer can, in embodiments, be prepared by a number of known methods, the process parameters being dependent, for example, on the photoconductor member desired. The hole blocking layer can be coated as a solution or a dispersion onto the photoconductor supporting substrate, or on to the ground plane layer by the use of a spray coater, a dip coater, an extrusion coater, a roller coater, a wire-bar coater, a slot coater, a doctor blade coater, a gravure coater, and the like, and dried at, for example, from about 40 to about 200° C. or from 75 to 150° C. for a suitable period of time, such as for example, from about 1 to about 4 hours, from about 1 to about 10 hours, or from about 40 to about 100 minutes in the presence of an air flow. The hole blocking layer coating can be accomplished in a manner to provide a final hole blocking layer thickness after drying of, for example, from about 0.01 to about 30 microns, from about 0.02 to about 5 microns, or from about 0.03 to about 2 microns.

Adhesive Layer

An optional adhesive layer may be included between the photoconductor hole blocking layer and the photogenerating layer. Typical adhesive layer materials selected for the photoconductors illustrated herein, include polyesters, polyurethanes, copolyesters, polyamides, poly(vinyl butyrals), poly (vinyl alcohols), polyacrylonitriles, and the like, and mixtures thereof. The adhesive layer thickness can be, for example, from about 0.001 to about 1 micron, from about 0.05 to about 0.5 micron, or from about 0.1 to about 0.3 micron. Optionally, the adhesive layer may contain effective suitable amounts of from about 1 to about 10 weight percent, or from about 1 to about 5 weight percent of conductive particles such as zinc oxide, titanium dioxide, silicon nitride, and carbon black, nonconductive particles, such as polyester polymers, and mixtures thereof.

Photogenerating Layer

Usually, the disclosed photoconductor photogenerating layer is applied by vacuum deposition or by spray drying onto the supporting substrate, and a charge transport layer or plurality of charge transport layers are formed on the photogenerating layer. The charge transport layer may be situated on the photogenerating layer, the photogenerating layer may be situated on the charge transport layer, or when more than one charge transport layer is present, they can be contained on the photogenerating layer. Also, the photogenerating layer may be applied to layers that are situated between the supporting substrate and the charge transport layer.

Generally, the photogenerating layer can contain known photogenerating pigments, such as metal phthalocyanines, metal free phthalocyanines, alkylhydroxyl gallium phthalocyanines, hydroxygallium phthalocyanines, halogallium phthalocyanines, such as chlorogallium phthalocyanines, perylenes, such as bis(benzimidazo)perylene, titanyl phthalocyanines, especially Type V titanyl phthalocyanine, and the like, and mixtures thereof.

Examples of photogenerating pigments included in the photogenerating layer are vanadyl phthalocyanines, Type V hydroxygallium phthalocyanines, high sensitivity titanyl phthalocyanines, Type IV and V titanyl phthalocyanines, quinacridones, polycyclic pigments, such as dibromo anthanthrone pigments, perinone diamines, polynuclear aromatic quinones, azo pigments including bis-, tris- and tetrakis-azos, and the like, and other known photogenerating pigments; inorganic components such as selenium, selenium alloys, and trigonal selenium; and pigments of crystalline selenium and its alloys.

The photogenerating pigment can be dispersed in a resin binder similar to the resin binders selected for the charge transport layer, or alternatively no resin binder need be present. For example, the photogenerating pigments can be present in an optional resinous binder composition in various amounts inclusive of up to about 99.5 to 100 weight percent by weight based on the total solids of the photogenerating layer. Generally, from about 5 to about 95 percent by volume of the photogenerating pigment is dispersed in about 95 to about 5 percent by volume of a resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition.

Examples of polymeric binder materials that can be selected as the matrix for the disclosed photogenerating layer pigments include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like, inclusive of block, random, or alternating copolymers thereof.

It is often desirable to select a coating solvent for the disclosed photogenerating layer mixture, and which solvent does not substantially disturb or adversely affect the previously coated layers of the photoconductor. Examples of coating solvents used for the photogenerating layer coating mixture include ketones, alcohols, aromatic hydrocarbons, halogenated aliphatic hydrocarbons, ethers, amines, amides, esters, and the like, and mixtures thereof. Specific solvent examples selected for the photogenerating mixture are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer can be of a thickness of from about 0.01 to about 10 microns, from about 0.05 to about 10 microns, from about 0.2 to about 2 microns, or from about 0.25 to about 1 micron.

Charge Transport Layer

The disclosed charge transport layer or layers, and more specifically, in embodiments, a first or bottom charge transport layer in contact with the photogenerating layer, and over the first or bottom charge transport layer a top or second charge transport overcoating layer, comprise charge transporting compounds or molecules dissolved, or molecularly dispersed in a film forming electrically inert polymer such as a polycarbonate. In embodiments, "dissolved" refers, for example, to forming a solution in which the charge transport molecules are dissolved in a polymer to form a homogeneous phase; and molecularly dispersed refers, for example, to charge transporting molecules or compounds dispersed on a molecular scale in a polymer.

Also disclosed is a photoconductor comprising a photogenerating layer, a charge transport layer, and an overcoat layer comprising a mixture of a phenolic compound, a phosphite compound, an optional charge transport compound, and an optional melamine resin, and where the charge transport layer is comprised of a top charge transport layer and a bottom charge transport layer, with the bottom charge transport layer being situated between the photogenerating layer and the top charge transport layer, and wherein in the bottom charge transport layer, the top charge transport layer, or both the bottom charge transport layer and top charge transport layer there is present a charge transport compound selected, for example, from the group consisting of N,N,N',N'-tetra-p-tolyl-1,1'-biphenyl-4,4'-diamine, N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

In embodiments, charge transport refers, for example, to charge transporting molecules that allows the free charge generated in the photogenerating layer to be transported across the charge transport layer. The charge transport layer is usually substantially nonabsorbing to visible light or radiation in the region of intended use, but is electrically active in that it allows the injection of photogenerated holes from the photoconductive layer, or photogenerating layer, and permits these holes to be transported to selectively discharge surface charges present on the surface of the photoconductor.

A number of charge transport compounds can be included in the charge transport layer or in at least one charge transport layer where at least one charge transport layer is from 1 to about 4 layers, from 1 to about 3 layers, 2 layers, or 1 layer. Examples of charge transport components or compounds present in an amount of from about 20 to about 80 weight percent, from about 30 to about 70 weight percent, or from about 40 to about 60 weight percent based on the total solids of the at least one charge transport layer are the compounds as illustrated in Xerox U.S. Pat. No. 7,166,397, the disclosure of which is totally incorporated herein by reference, and more specifically, aryl amines selected from the group consisting of those represented by the following formulas/structures

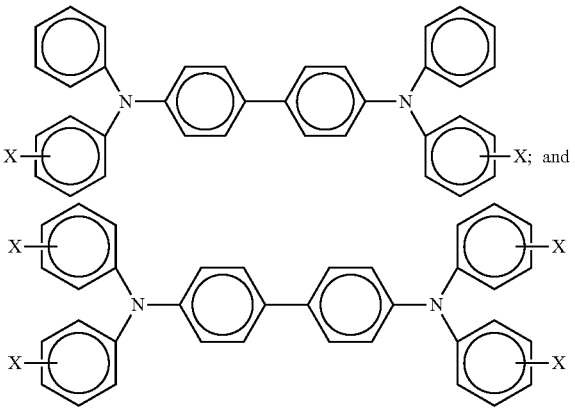

wherein X is a suitable hydrocarbon like alkyl, alkoxy, aryl, isomers thereof, and derivatives thereof like alkylaryl, alkoxyaryl, arylalkyl; a halogen, or mixtures of a suitable hydrocarbon and a halogen; and charge transport layer compounds as represented by the following formulas/structures

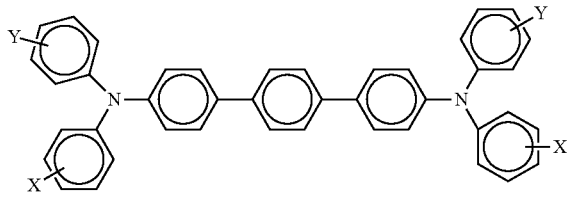

wherein X and Y are independently alkyl, alkoxy, aryl, a halogen, or mixtures thereof.

Alkyl and alkoxy for the photoconductor charge transport layer compounds illustrated herein contain, for example, from about 1 to about 25 carbon atoms, from about 1 to about 12 carbon atoms, or from about 1 to about 6 carbon atoms, such as methyl, ethyl, propyl, butyl, pentyl, hexyl, heptyl, octyl, nonyl, decyl, undecyl, dodecyl, pentadecyl, and the like, and the corresponding alkoxides. Aryl substituents for the charge transport layer compounds can contain from 6 to about 36, from 6 to about 24, from 6 to about 18, or from 6 to about 12 carbon atoms, such as phenyl, naphthyl, anthryl, and the like. Halogen substituents for the charge transport layer compounds include chloride, bromide, iodide, and fluoride. Substituted alkyls, substituted alkoxys, and substituted aryls can also be selected for the disclosed charge transport layer compounds.

Examples of specific aryl amines present in at least one photoconductor charge transport layer, in an amount of from about 20 to about 80 weight percent, from about 30 to about 70 weight percent, or from about 40 to about 60 weight percent, include N,N,N',N'-tetra-p-tolyl-1,1-biphenyl-4,4'-diamine, N,N'-diphenyl-N,N'-bis(alkylphenyl)-1,1'-biphenyl-4,4'-diamine wherein alkyl is selected from the group consisting of methyl, ethyl, propyl, butyl, hexyl, heptyl, octyl, nonyl, decyl, undecyl, dodecyl, pentadecyl, and the like, N,N'-diphenyl-N,N'-bis(halophenyl)-1,1'-biphenyl-4,4'-diamine wherein the halo substituent is chloro, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like, hydrazones such as N-phenyl-N-methyl-3-(9-ethyl)carbazyl hydrazone and 4-diethyl amino benzaldehyde-1,2-diphenyl hydrazine, or oxadiazoles such as 2,5-bis(4-N,N'-diethylaminophenyl)-1,2,4-oxadiazole, stilbenes, and the like.

Various processes may be used to mix, and thereafter, apply the charge transport layer or layers coating mixture to the photogenerating layer. Typical application techniques include spraying, dip coating, roll coating, wire wound rod coating, and the like. Drying of the deposited charge transport layer coating or plurality of coatings may be affected by any suitable conventional technique such as oven drying, infrared radiation drying, air drying, and the like.

The thickness of the charge transport layer or charge transport layers, in embodiments, is from about 5 or about 10 to about 70 microns, from about 20 to about 65 microns, from about 15 to about 50 microns, or from about 10 to about 40 microns, but thicknesses outside this range may, in embodiments, also be selected. The charge transport layer should be an insulator to the extent that an electrostatic charge placed on the charge transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances about 400:1.

Examples of polymeric binder materials that can be selected as the matrix for the disclosed at least one charge transport layer include know components such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like, inclusive of block, random, or alternating copolymers thereof.

The at least one charge transport binder can be present in various amounts, such as for example, from about 20 to about 80 weight percent, from about 30 to about 70 weight percent, or from about 40 to about 60 weight percent based on the total solids, and where the total of the charge transport layer compound and the binder is about 100 percent.

Examples of components or materials optionally incorporated into at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd. Of Japan), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUM1LIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent based upon the total solids.

Also included within the scope of the present disclosure are methods of imaging and printing with the photoconductors illustrated herein. These methods generally involve the formation of an electrostatic latent image on the imaging member, followed by developing the image with a toner composition comprised, for example, of thermoplastic resin, colorant, such as pigment, charge additive, and surface additive, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductors disclosed herein can be selected for the Xerox Corporation iGEN® machines that generate with some versions over 100 copies per minute. Processes of imaging, especially xerographic imaging and printing, including digital and/or color printing are thus encompassed by the present disclosure. The imaging members are, in embodiments, sensitive in the wavelength region of, for example, from about 400 to about 900 nanometers, and from about 650 to about 850 nanometers, thus diode lasers can be selected as the light source. Moreover, the imaging members of this disclosure are useful in color xerographic applications, particularly high-speed color copying and printing processes inclusive of digital xerographic processes.

The thicknesses of each of the photoconductor layers illustrated herein were determined by known analytical methods and more specifically by the use of a Permascope. The molecular weights of the components and compounds illustrated herein were determined by Gel Permeation Chromatography (GPC).

The following Examples are being submitted to illustrate embodiments of the present disclosure. These Examples are intended to be illustrative only, and are not intended to limit the scope of the present disclosure. Also, parts and percentages are by weight unless otherwise indicated. The thicknesses of each layer were measured by a Permascope. Comparative Examples and data are also provided.

Overcoating Mixture

An overcoat layer solution (master batch) was prepared by mixing 208 grams of the charge transport compound, N,N'-diphenyl-N,N-diphenyl-N,N'-bis(3-hydroxyphenyl)-[1,1'-biphenyl]-4,4'-diamine, 104.3 grams of the melamine resin, CYMEL®303LF, 16.6 grams of the low surface energy component, SILCLEAN® 3700, 17.6 grams of the acid catalyst p-toluene sulfonic acid available as NACURE® XP357 in 653.4 grams of 1-methoxy-2-propanol, known as Dowanol PM.

Two coating solutions were then prepared: (1) for the Comparative Example 1 solution, 5 grams of cyclopentanone were added to 80 grams of the above prepared master batch solution followed by extensive mixing; and (2) for the Example I solution, 0.26 gram of CYANOX® 2777, a 1:2 blend of 1,3,5-tris(4-tert-butyl-3-hydroxy-2,6-dimethylbenzyl)-1,3,5-triazine-2,4,6-(1H,3H,5H)-trione and tris(2,4-di-t-butylphenyl)phosphite was first dissolved in 5 grams of cyclopentanone, and then added to 80 grams of the above master batch solution.

There resulted for (1) the Comparative Example 1 coating solution about 30 weight percent solids, and (2) for the Example I coating solution about 1 weight percent of CYANOX® 2777 and about 30 weight percent solids.

Photoconductor Examples

Two 84 millimeters×357 millimeters photoconductors were prepared as follows. Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting coating solution layer was preheated at 59° C. for 13 minutes, humidified at 58° C. (dew point=54° C.) for 17 minutes, and dried at 135° C. for 8 minutes. Subsequently, the obtained undercoat layer solution was coated by a dip coater on a 84 millimeters×357 millimeters aluminum drum substrate. The thickness of the resulting undercoat layer was approximately 1.3 microns.

A photogenerating layer of a thickness of about 0.2 micron comprising a hydroxygallium phthalocyanine Type V dispersion was deposited by dip coating on the above 1.3 micron thick undercoat layer. The photogenerating layer coating dispersion was prepared as follows. Three grams of the hydroxygallium phthalocyanine Type V pigment were mixed with 2 grams of a polymeric binder of a carboxyl-modified vinyl copolymer, VMCH, available from Dow Chemical Company, and 45 grams of n-butyl acetate. The resulting mixture was mixed in an Attritor mill with about 200 grams of 1 millimeter Hi-Bea borosilicate glass beads for about 3 hours. The dispersion obtained was filtered through a 20 micron NYLON cloth filter, and the solid content of the dispersion was diluted to about 6 weight percent.

Subsequently, a 24 micron thick charge transport layer was coated on top of the photogenerating layer from a solution prepared from mixing N,N'-diphenyl-N,N-bis(3-methylphenyl)-1,1'-biphenyl-4,4'-diamine (5 grams), and a film forming polymer binder PCZ-400 (poly(4,4'-dihydroxy-diphenyl-1-1-cyclohexane)carbonate, weight average molecular weight, $M_w$ of 40,000) obtained from Mitsubishi Gas Chemical Company, Ltd. (7.5 grams) in a solvent mixture of 30 grams of tetrahydrofuran (THF) and 10 grams of monochlorobenzene (MCB). The charge transport layer was dried at about 120° C. for about 20 minutes.

The above Comparative Example 1 and Example I overcoat layer solutions were coated on the charge transport layer, respectively. The resultant overcoat layer was dried in a forced air oven for 40 minutes at 155° C. to yield a highly, about 95 percent, crosslinked, 4.5 micron thick overcoat layer, and which overcoat layer was substantially insoluble in methanol or ethanol.

The ratio of PCZ-400 to N,N'-diphenyl-N,N-bis(3-methylphenyl)-1,1'-biphenyl-4,4'-diamine in the Comparative Example 1 charge transport layer was 60/40; and the ratio of N,N'-diphenyl-N,N'-bis(3-hydroxyphenyl)-[1,1'-biphenyl]-4,4'-diamine to the melamine resin/acid catalyst/low surface energy component in the Example 1 overcoat layer was 45.2/52.8/1/1.

Light Shock Reduction

An in-house light shock test was performed for the above prepared photoconductor devices (Comparative Example 1 and Example I). Half of the above prepared photoconductors were covered with a black paper, and then exposed under office light for 120 minutes, and the resulting PIDCs (photoinduced discharge curves) were measured quickly after light exposure for both the light exposed half and the light non-exposed half. The light shock results are summarized in Table 1. The surface potential at 1.5 ergs/cm$^2$ light exposure was recorded for each PIDC, and ΔV(1.5 ergs/cm$^2$) was calculated as an indication for light shock resistance. The smaller the ΔV(1.5 ergs/cm$^2$) represents a more light shock resistant photoconductor.

The disclosed Example I overcoated photoconductor comprising about 1 weight percent of CYANOX® 2777 was light shock resistant. The Example I ΔV((delta volts, at 1.5 ergs/

$cm^2$, before and after light fatigue) was about 3V (volts), which indicated that there was almost no change in PIDC before and after the light exposure. In contrast, the Comparative Example I overcoated photoconductor comprising no CYANOX® 2777 had a $\Delta V(1.5\ ergs/cm^2)$ of about 30 V.

TABLE 1

| | $\Delta V(1.5\ ergs/cm^2)$ |
|---|---|
| Comparative Example 1 (with no CYANOX ® 2777) | 30 V (volts) |
| Example I (with 1 Percent of CYANOX ® 2777) | 3 V |

Light shock, such as occurring with the photoconductor of the above Comparative Example 1, caused dark bands in xerographic prints when the photoconductor was exposed to light at t equal to 0 (time zero). The light shock resistant Example I photoconductor did not xerographically print dark bands even when the photoconductor was exposed to white light.

The light shock resistance $\Delta V(1.5\ ergs/cm^2)$ of the above Example I photoconductor can be, it is believed, from about 1 to about 15, from 1 to about 12, from 1 to about 10, or from 1 to about 5 volts.

The above PIDCs (photo-induced discharge curves) were obtained by know processes, and more specifically, by using a scanner sequenced at one charge-erase cycle, wherein the light intensity was incrementally increased with cycling from which the photosensitivity and surface potentials at various exposure intensities can be measured. The scanner was equipped with a scorotron set to a constant voltage charging at various surface potentials. The photoconductors were tested at surface potentials of −700 volts with the exposure light intensity incrementally increased by means of a data acquisition system where the current to the light emitting diode was controlled to obtain different exposure levels. The exposure light source was a 780 nanometer light emitting diode.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, a charge transport layer, and a crosslinked overcoat layer comprising a phenolic compound, a phosphite compound and a melamine resin wherein said overcoat layer further comprises a catalyst, said phenolic compound is 1,3,5-tris(4-tert-butyl-3-hydroxy-2,6-dimethylbenzyl)-1,3,5-triazine-2,4,6-(1H,3H,5H)-trione present in an amount of from about 0.5 to about 1.5 weight percent based on the total solids, said phosphite is tris(2,4-di-t-butylphenyl) phosphite present in an amount of from about 0.5 to about 1.5 weight percent based on the total solids, said overcoat charge transport compound is N,N'-diphenyl-N,N-diphenyl-N,N'-bis(3-hydroxyphenyl)-[1,1'-biphenyl]-4,4'-diamine present in an amount of from about 40 to about 70 weight percent based on the total solids, and said catalyst is a toluene sulfonic acid present in an amount of from about 0.5 to about 1.5 weight percent based on the total solids.

2. A photoconductor in accordance with claim 1 wherein said charge transport layer comprises a compound selected from the group consisting of those as represented by the following formulas/structures

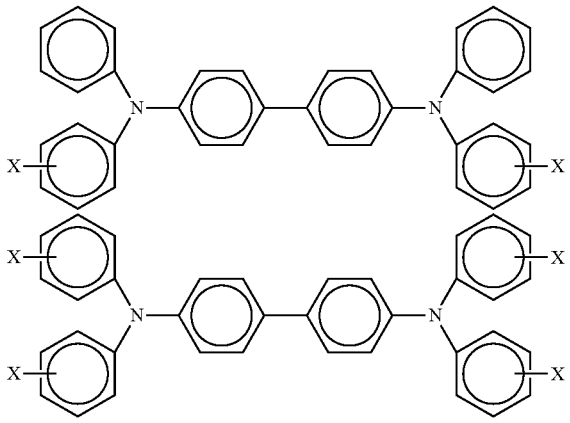

wherein X is selected from the group consisting of alkyl, alkoxy, aryl, halogen, and mixtures thereof; and

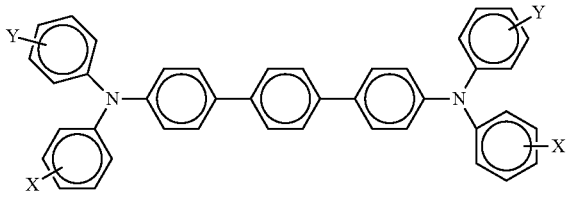

wherein each X and Y is independently selected from the group consisting of at least one of alkyl, alkoxy, aryl, and halogen.

3. A photoconductor in accordance with claim 2 wherein said charge transport layer is comprised of a top charge transport layer and a bottom charge transport layer, and wherein said bottom charge transport layer is situated between said photogenerating layer and said top charge transport layer, and wherein in said charge transport layer there is present a compound selected from the group consisting of N,N,N',N'-tetra-p-tolyl-1,1'-biphenyl-4,4'-diamine, N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

4. A photoconductor in accordance with claim 1 wherein said melamine resin is selected from the group consisting of methylated melamine resins, methoxymethylated melamine resins, ethoxymethylated melamine resins, propoxymethylated melamine resins, butoxymethylated melamine resins, hexamethylol melamine resins, methoxymethylated melamine resins, ethoxymethylated melamine resins, propoxymethylated melamine resins, butoxymethylated melamine resins, and mixtures thereof.

5. A photoconductor in accordance with claim 1 wherein said photogenerating layer is comprised of photogenerating pigments selected from the group consisting of a titanyl phthalocyanine, a halogallium phthalocyanine, a hydroxygallium phthalocyanine, and mixtures thereof.

6. A photoconductor in accordance with claim 1 wherein said photoconductor further includes a hole blocking layer and an adhesive layer, and said charge transport layer contains a hindered phenol or a hindered amine.

7. A photoconductor in accordance with claim 1 wherein a crosslinked amount is from about 80 to about 95 percent as determined with Fourier Transform Infrared Spectroscopy (FTIR).

8. A photoconductor in accordance with claim 1 that possesses a light shock resistant with delta Volts at 1.5 ergs/$cm^2$ of from about 1 to about 10 Volts as measured by a photoinduced discharge curve.

* * * * *